United States Patent [19]

Nahar et al.

[11] 4,295,645

[45] Oct. 20, 1981

[54] DOCUMENT HOPPER WITH ECCENTRIC FLOOR CYLINDERS AND A FRONT AUGER

[75] Inventors: Rathindra Nahar, Wayne; Robert H. Dietze, Bloomfield Hills, both of Mich.

[73] Assignee: Burroughs Corporation, Detroit, Mich.

[21] Appl. No.: 122,508

[22] Filed: Feb. 19, 1980

[51] Int. Cl.[3] ..... B65H 3/04

[52] U.S. Cl. ..... 271/34; 271/146; 271/149; 271/160; 271/221

[58] Field of Search ..... 271/34, 35, 30 A, 129, 271/149, 160, 221, 178, 179, 146

[56] References Cited

U.S. PATENT DOCUMENTS 3,468,531 9/1969 Whittington ..... 271/149
3,682,473 8/1972 Kuyt ..... 271/179 X
3,995,851 12/1976 Casper ..... 271/179
4,049,257 9/1977 Frystak ..... 271/160 X

*Primary Examiner*—Richard A. Schacher
*Attorney, Agent, or Firm*—Delbert P. Warner; Charles E. Quarton; Kevin R. Peterson

[57] ABSTRACT

Hopper for feeding documents automatically into a sorter. The hopper employs rotating eccentric rollers protruding through slots in the bottom of the hopper to drive documents in a direction perpendicular to the rollers across the hopper against front or first wall. A rotary roller extending through a slot along this wall is used to urge the ends of the documents downward and forward towards feeder nudger belts which feed them to the sorter. A spring biased flag pushes against one end of the stack of documents to urge them in the same direction against the feeder nudger belts.

5 Claims, 7 Drawing Figures

DOCUMENT HOPPER WITH ECCENTRIC FLOOR CYLINDERS AND A FRONT AUGER

BACKGROUND OF THE INVENTION

1. Field of the Invention

The present invention relates to document handling and sorting equipment and particularly to handling equipment which accepts a bundle of documents and delivers them to follow-on equipment to be sorted, read, printed and the like. It relates especially to handling bundles of documents and transporting the bundles in such a way that they are prepared so that subsequent stages of paper handling apparatus can receive and treat the documents individually.

2. Description of the Prior Art

The prior art to which this invention most closely relates includes devices for jogging or shaking a box or hopper to impart vibrations to documents placed in the box or hopper. The documents are aligned along one edge by the vibrations which also reduce any tendencies of the documents to stick together before sorting. A problem with joggers or other shaking devices is that, despite attempts to isolate vibrations, they still impart undesirable vibrations to other parts of the sorting machines. In addition, these prior art joggers add considerable noise to the immediate vicinity of the machine.

A common problem with which prior art machines have dealt has been that of overcoming friction between the documents being sorted and the floor of the hopper. As indicated before, one approach has been to jog or shake the box or hopper. Besides the disadvantages of increased vibrations and noise in the machine, this method has not provided the desired mobility of documents across the hopper floor. As the sizes of hoppers have been increased and the sizes of stacks of documents have also been increased, changes in the total friction represented have increased so that these prior art devices have been less effective than desired while vibrations and noise have increased greatly.

BRIEF DESCRIPTION OF THE INVENTION

The invention relates to apparatus for delivering documents to feeder nudger belts of a sorting machine for transmittal to the sorting machine.

A preferred embodiment includes an open-topped box or hopper, having a base and walls, into which a stack of documents may be placed on one edge, in a position perpendicular to slots in the base, for sorting. A plurality of eccentric rollers are placed under the base and extended through the slots in the base to engage the edges of the documents in the stack. The rollers are driven by a motor so that they rotate counterclockwise when viewed from a first end of the hopper and drive the documents in a first direction which forces first ends of the document against a first wall of the hopper.

A roller is placed behind the first wall of the hopper in a position such that it extends through a slot, or slots, in the wall to engage the first ends of the documents. In a preferred embodiment this roller is provided with left-handed threads and is turned by the motor in the opposite direction to that of the plurality of rollers, or clockwise as seen from the first end of the hopper, so that the threads tend to fan the ends of the documents apart while the friction of the roller itself tends to drive the ends of the documents downward to keep the edge in contact with the first set of rollers and to drive the documents towards the feeder nudger belts.

The plurality of rollers extending through the floor of the hopper may be of plain cylindrical stock or may incorporate threaded surfaces. In a model constructed using plain cylinders, the cylinders were made eccentric so that they imparted a lifting and dropping effect to the documents, at times making the documents airborne to reduce friction, and helping to break up the bunching of documents, whatever the cause of that bunching. In a model employing cylinders having threaded surfaces, the cylinders were equipped with right-handed threads and were rotated counter clockwise as seen from the first end of the hopper to drive the documents towards the feeder nudger belts.

Eccentric bores may be employed in conjunction with threaded surfaces on cylinders extending through the floor of the hopper, if desired. Similarly, non-eccentric bores may be employed with some or all of the cylinders if plain cylinders are extended through the floor of the hopper. It will be seen also that various combinations of eccentric, non-eccentric, threaded and plain cylinders may be utilized.

Flag means, biased by a spring may be used to impart a constant force to the side of a bundle of documents in the hopper which will drive the documents with a relatively constant normal force and at a constant rate in the direction of the feeder-nudger belts.

It is an object, therefore, of this invention to provide improved means for handling bundles of documents in a manner enabling the presentation of a moving stack of documents to feeder nudger belts with a relatively constant normal force for every document in the stack while eliminating a principle cause for noise and vibrations in a sorting machine.

DESCRIPTION OF THE INVENTION

Figure 1:
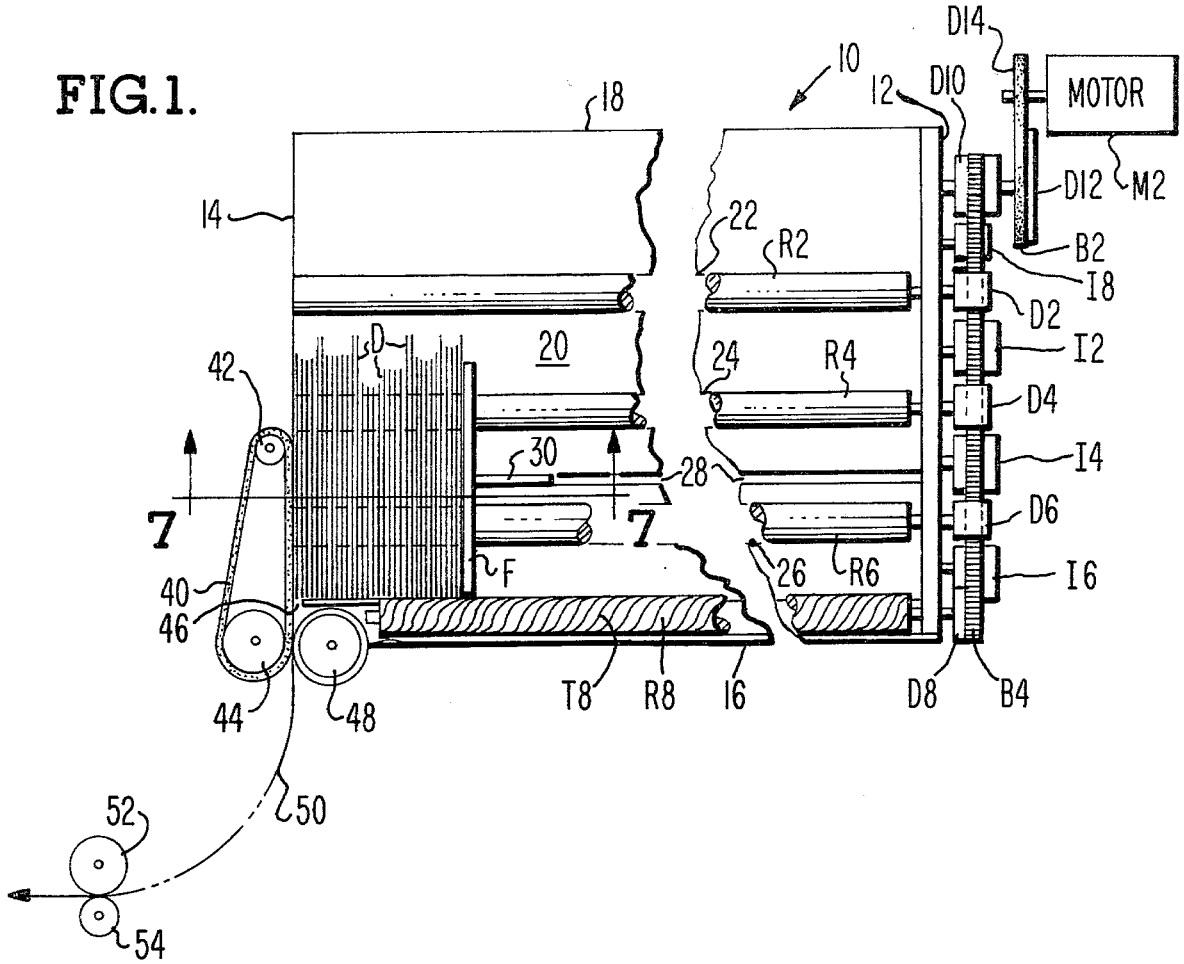
FIG. 1 is a plan view showing a hopper in accordance with the invention as it relates to a transport mechanism.

Turning first to FIG. 1, a hopper is indicated at 10. The shell of this hopper is basically an open-topped box having an end wall at 12, side walls at 16 and 18 and a bottom or floor 20. In use, the hopper may be fastened securely to the transport mechanism of a document sorter.

A plurality of slots 22, 24, 26 and 28 extend through and along the floor of the hopper parallel to the sides 16 and 18, as indicated. Rollers R2, R4 and R6 are aligned parallel to the side walls of the hopper under the floor 20 in positions such that their upper peripheries protrude through the slots 22, 24 and 26. The rollers R2, R4 and R6 are shown as single elements but may be formed of a plurality of single segments, if desired. The rollers are supported at each end by suitable bearings and are driven at one end by drive wheels D2, D4 and D6, respectively.

A slot 28 through the bottom of hopper 10 provides a path for an extension 30 of a stacker pocket back-up assembly, or flag, F. The extension 30 is secured at one end to the end of a spring S of a kind similar to those used to make retractable steel rules. The spring S has an end which winds on a reel in a housing S2 (FIG. 7) enabling S to provide a relatively constant force to the flag F regardless of the number of documents D which are present in the hopper.

A slot (32, FIG. 2) through the wall 16 of the hopper 10, provides an opening through which a portion of a roller R8 is extended. In a preferred embodiment, the surface of this roller will be provided with left-handed threads as indicated at T8 in FIG. 1. The threaded roller, or auger, R8 is driven by a drive wheel D8 in a clockwise direction, as viewed in FIG. 2, so that the periphery of the roller pushes the ends of the documents downward to prevent the documents from flying from the hopper. As the roller R8 turns clockwise, the left-handed threads exert forces across the ends of the documents in the direction of travel, thereby fanning the documents to insure separation of the documents from each other.

As indicated in FIG. 1, the flag F presses against a stack of documents D, as urged by the spring S. As previously indicated, a preferred embodiment of the spring S is a coil spring which is wrapped on a spool in a fashion analogous to that of a steel retractable rule. The spring provides a force which is substantially constant when applied to stacks of documents of widely different thicknesses. The flag, as urged by the spring, pushes the documents D in the direction of feeder nudger belts at 40 which are moved over the pulleys 42 and 44 by a motor on a shaft behind the pulley 44. The feeder nudger belts 40 separate a document or a few documents from the stack, pushing them through a slot at 46 into contact with the tires 44 and 48. The tires 44 and 48, in a well-known manner, separate the documents received by them so that only one document at a time is transported through a track 50 to rollers 52 and 54 for transport further along the track.

Figure 2:
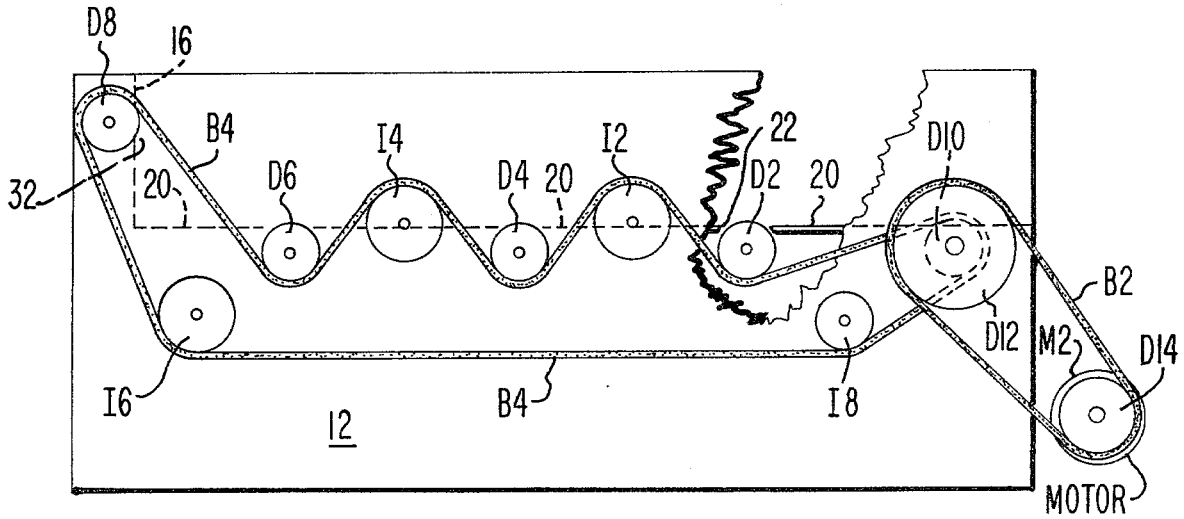
FIG. 2 is an end view of FIG. 1 showing the arrangement of driving mechanisms for the rollers.

The rollers R2, R4, R6 and R8 are operated synchronously by a timing belt driven by a single motor M2, as indicated in FIG. 2. The motor M2 turns the drive pulley D14 which imparts a driving force to drive pulleys D12 and D10 through a timing belt B2. The drive pulley D10, through timing belt B4, then drives the drive pulleys D2, D4, D6 and D8 and the idle pulleys I2, I4, I6 and I8. As indicated, the drive pulleys D2, D4 and D6 and the corresponding rollers R2, R4 and R6 are turned counterclockwise so that the upper peripheries of the rollers drive documents to the left in FIG. 2. Drive pulley D8 is rotated clockwise to turn roller R8 clockwise and drive the leading edges of the documents downward.

Figure 3:
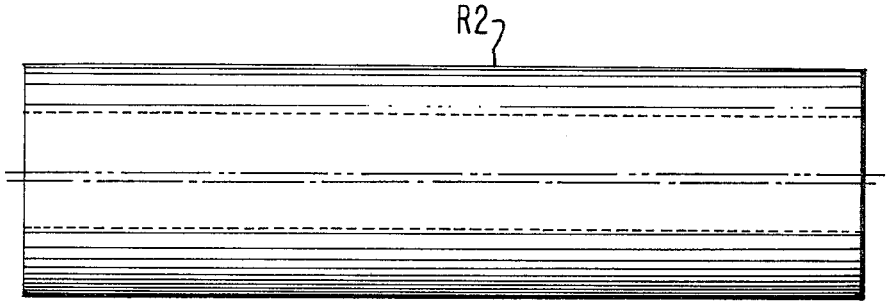
FIG. 3 is a side view of an eccentric cylindrical roller of use in the practice of the invention.
Figure 4:
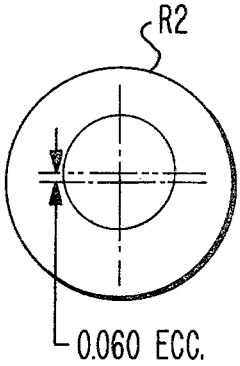
FIG. 4 is an end view of the roller of FIG. 3 showing the eccentricity thereof.

FIG. 3 depicts a section of the roller R2 which may be prepared in several short sections or a single long section. In a particular example, six short sections were employed on a shaft with each section being independently bored. As indicated in FIG. 4, which is an end view of the roller of FIG. 3, the bore may be made eccentric. In a particular case, eccentricity of 1/16 inch was used, but a lesser eccentricity of the order of 1/32 inch or less may be used.

The effect produced by an eccentric bore of the rollers as the rollers rotate is to lift the documents up, rendering them airborne for brief periods during which time friction between the documents and the rollers is reduced to zero and the flag F may more readily move the documents toward the feeding end of the hopper.

Figure 5:
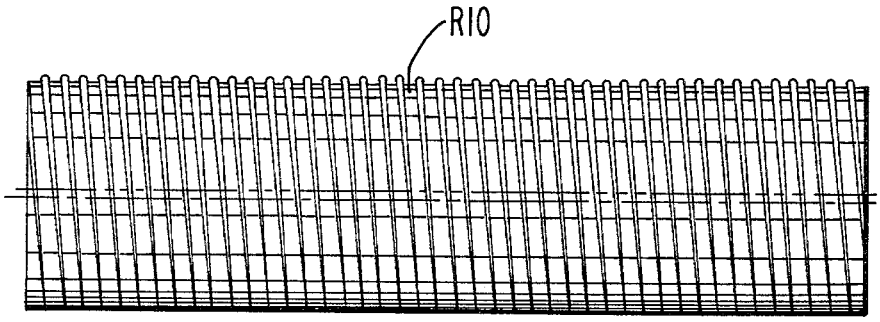
FIG. 5 is a side view of a threaded roller, employing right-handed threads, for use in the floor of the hopper.
Figure 6:
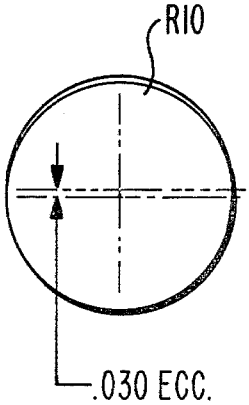
FIG. 6 is an end view of the roller of FIG. 5 illustrating eccentricity thereof.

As indicated in FIGS. 5 and 6 rollers designated R10 may have their surfaces inscribed with right-hand threads. These rollers may then be substituted for rollers R2, R4 and R6 in the bottom of the hopper. In such a case, with the rollers rotating counter clockwise as seen from the driving end of the hopper, the threads will advance in the direction in which the documents are driven by the flag F. The threads will therefore effectively fan the edges of the documents and thus assure better separation between documents.

Figure 7:
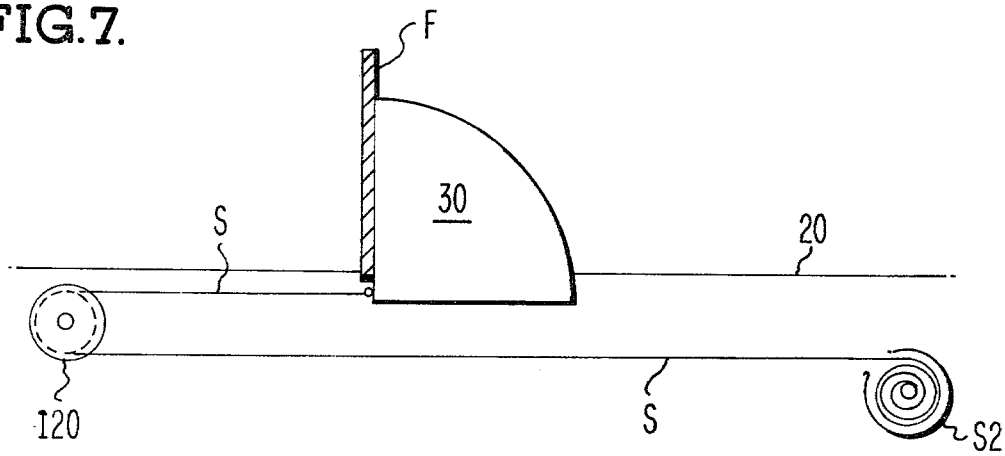
FIG. 7 is a view in partial section of the flag shown in FIG. 1.

FIG. 7 is a sectional view taken along line 7—7 in FIG. 1. This view shows a spring S secured at one end to the flag F and by the other end to a spool, shown in a housing S2. The spring S coils on the spool as it draws the flag F towards the left. An idler wheel at I20 provides for reversal of direction of the forces applied by the spring S.

What is claimed is:

1. A feeder hopper for feeding documents into the feeder nudger belts of a document sorter, comprising:

a base including an open-topped box having a bottom and walls for receiving stacks of documents;

a plurality of openings forming slots through the bottom of said box;

a plurality of rollers extending through the slots in the bottom of the box to serve as low friction supports for the edges of documents placed in the box;

means causing said rollers to rotate and contact edges of documents placed on edge in the box, thereby driving the documents in a first direction to force first ends of the documents against one wall of the box;

an opening forming a slot through said one wall of said box;

an additional roller extending through the slot in the one wall of the box in a position enabling it to engage said first ends of the documents;

means causing said additional roller to rotate in a manner to enable it to contact the first ends of the documents;

each of the plurality of rollers having an eccentric axis about which it rotates;

each eccentric axis enabling a roller, as it rotates, alternately to lift up and drop documents in contact with said roller, thereby lessening the effects of friction on and between the documents to prepare them for ready movement in a second direction substantially orthogonal to the first;

said additional roller having an eccentric axis about which it rotates;

said eccentric axis enabling the additional roller, as it rotates, to push against the ends of documents causing them to move between positions determined by motion of the plurality of rollers and positions determined by the eccentricity of the additional roller; and flag means aligned to engage the stack of documents and biased to force the documents in the second direction, thereby driving the documents in the second direction.

2. The invention as claimed in claim 1, in which:

the additional roller incorporates a left-handed thread; and the additional roller is turned clockwise in a manner causing the threads to advance in the second direction of motion of the documents, thereby fanning the ends of the documents and enabling them to separate temporarily from adjacent documents.

3. The invention as claimed in claims 1 or 2 in which:

each of the plurality of rollers is substantially cylindrical in form; and the rollers rotate in a direction causing their upper peripheries to move documents toward the wall through which the additional roller extends.

4. The invention as claimed in claim 1 or 2 in which:

each of the plurality of rollers is substantially cylindrical in form and bears threads on its surface; and the rollers rotate in a direction causing their upper peripheries to move documents in the hopper toward the wall through which the threaded roller extends and their threads to urge documents in the second direction.

5. The invention as claimed in claims 1 or 2 in which:

each of the plurality of rollers is substantially cylindrical in form and bears right-handed threads on its surface; and the plurality of rollers rotate counterclockwise in a direction causing their upper peripheries to move documents in the hopper toward the wall through which the threaded roller extends and their threads to urge documents in the second direction.

* * * * *